US007520409B2

(12) United States Patent
Bougamont et al.

(10) Patent No.: US 7,520,409 B2
(45) Date of Patent: Apr. 21, 2009

(54) DISTRIBUTOR FOR A LIQUID OR GEL PRODUCT

(75) Inventors: Jean-Louis Bougamont, Eu (FR); Pierre Dumont, Monchy-sur-Eu (FR); Jean-Luc Octau, Intraville (FR)

(73) Assignee: Rexam Dispensing Systems S.A.S. (FR)

( * ) Notice: Subject to any disclaimer, the term of this patent is extended or adjusted under 35 U.S.C. 154(b) by 420 days.

(21) Appl. No.: 11/280,060

(22) Filed: Nov. 16, 2005

(65) Prior Publication Data

US 2006/0131342 A1 Jun. 22, 2006

Related U.S. Application Data

(63) Continuation of application No. PCT/EP2004/004878, filed on May 7, 2004.

(30) Foreign Application Priority Data

May 16, 2003 (FR) ..... 03 05883

(51) Int. Cl.
*G01F 11/00* (2006.01)

(52) U.S. Cl. ..... 222/321.9; 222/321.6; 222/321.8; 222/341

(58) Field of Classification Search ... 222/321.2–321.9, 222/341
See application file for complete search history.

(56) References Cited

U.S. PATENT DOCUMENTS 4,369,900 A * 1/1983 Saito et al. ..... 222/321.2
4,462,549 A * 7/1984 Saito et al. ..... 239/333
4,606,479 A * 8/1986 Van Brocklin ..... 222/321.2
4,607,765 A * 8/1986 Ruscitti ..... 222/321.9
4,640,443 A * 2/1987 Corsette ..... 222/321.3
4,762,475 A * 8/1988 Fuchs ..... 417/550
4,773,553 A * 9/1988 Van Brocklin ..... 215/272
4,817,829 A * 4/1989 Fuchs et al. ..... 222/259
4,984,702 A * 1/1991 Pierpont ..... 215/272
5,046,644 A * 9/1991 Cater ..... 222/321.2
5,105,994 A * 4/1992 Jouillat et al. ..... 222/341
5,234,135 A * 8/1993 LaFosse et al. ..... 222/321.2
5,417,321 A * 5/1995 Halm ..... 206/221
5,649,649 A * 7/1997 Marelli ..... 222/321.2
5,687,883 A * 11/1997 Su ..... 222/321.2
5,894,963 A * 4/1999 Hirota ..... 222/321.2
5,918,778 A * 7/1999 Schultz ..... 222/321.7

(Continued)

FOREIGN PATENT DOCUMENTS

EP 0888 824 A1 7/1999

OTHER PUBLICATIONS

International Search Report, Aug. 11, 2004, 2 Pages.

*Primary Examiner*—Frederick C Nicolas
*Assistant Examiner*—Andrew P Bainbridge
(74) *Attorney, Agent, or Firm*—St. Onge Steward Johnston & Reens LLC

(57) ABSTRACT

The invention relates to a distributor for a liquid product, in particular, a miniature spray, having a reduced number of parts. The distributor includes a reservoir and a manual action pump, provided with a hollow push-button, arranged such as to slide in a sealed manner with relation to the exterior of a tubular neck of the pump body, defining a dosing chamber, extending at least partly into the interior of the push-button.

13 Claims, 3 Drawing Sheets

U.S. PATENT DOCUMENTS

| | | | | |
|---|---|---|---|---|
| 5,979,711 | A * | 11/1999 | Fuchs et al. | 222/321.2 |
| 6,123,234 | A * | 9/2000 | Lai | 222/321.7 |
| 6,394,318 | B1 * | 5/2002 | Klodzinski | 222/321.7 |
| 6,769,576 | B2 * | 8/2004 | Ichikawa | 222/321.5 |
| 6,776,311 | B2 * | 8/2004 | Ackermann | 222/321.7 |
| 6,932,246 | B2 * | 8/2005 | Crosnier et al. | 222/321.2 |
| 6,935,540 | B2 * | 8/2005 | Ackermann | 222/321.7 |
| 6,948,639 | B2 * | 9/2005 | Albisetti et al. | 222/321.2 |
| 7,014,068 | B1 * | 3/2006 | Cohen et al. | 222/321.9 |
| 7,243,821 | B2 * | 7/2007 | Bougamont et al. | 222/321.5 |
| 2001/0007327 | A1 * | 7/2001 | Ritsche et al. | 222/82 |
| 2001/0017304 | A1 * | 8/2001 | De Pous | 222/183 |
| 2001/0020627 | A1 * | 9/2001 | Meshberg | 222/1 |
| 2002/0003150 | A1 * | 1/2002 | Hermouet et al. | 222/321.2 |
| 2002/0047027 | A1 * | 4/2002 | Sogaro | 222/321.9 |
| 2002/0066753 | A1 * | 6/2002 | Greiner-Perth et al. | 222/321.6 |
| 2002/0179649 | A1 * | 12/2002 | Plessis | 222/321.9 |
| 2003/0150881 | A1 * | 8/2003 | Bougamont et al. | 222/321.9 |
| 2003/0209567 | A1 * | 11/2003 | Crosnier et al. | 222/321.9 |
| 2004/0099693 | A1 * | 5/2004 | Ackermann | 222/321.7 |
| 2004/0222242 | A1 * | 11/2004 | Ackermann | 222/321.2 |
| 2006/0054633 | A1 * | 3/2006 | Brugger | 222/94 |
| 2006/0065675 | A1 * | 3/2006 | Bougamont et al. | 222/321.9 |
| 2006/0131342 | A1 * | 6/2006 | Bougamont et al. | 222/321.2 |

* cited by examiner

DISTRIBUTOR FOR A LIQUID OR GEL PRODUCT

CROSS-REFERENCE TO RELATED APPLICATIONS

This application is a continuation of International Patent Application No. PCT/EP2004/004878 filed on May 7, 2004, which designates the United States and claims priority of French Patent Application No. 0305883 filed on May 16, 2003.

FIELD OF THE INVENTION

The invention relates to a dispenser of products in liquid or gel form, but relates particularly to a sprayer and especially to a miniature sprayer designed to contain a small dose of a luxury product, such as a perfume, for example. Such sprayers are mainly intended to be distributed free of cost in order to let customers get to know and appreciate a new product, for example, in the context of an advertising campaign.

BACKGROUND OF THE INVENTION

In the field of miniature sprayers intended to be offered to consumers, the aim is to reduce the manufacturing costs of the device by simplifying its structure, reducing the number of components and making it easier to manufacture and assemble. A product dispenser of this type usually comprises a reservoir and a manually activated pump mounted by force, like a plug, in an opening of the reservoir. The pump comprises a pump body forming the plug in which a needle valve or a piston is mounted, which is part of an outlet valve. The pump body is surmounted by a tappet-button mounted so as to be mobile in the extension of the body. The invention relates to a new arrangement of such a dispenser, optimised to reduce its manufacturing costs.

SUMMARY OF THE INVENTION

More specifically, the invention relates to a liquid product dispenser consisting of a reservoir and a manually activated pump comprising a pump body mounted watertight in an opening of the said reservoir and a tappet-button mounted in the extension of the said pump body and mobile along the axial direction of the latter, characterised in that the said tappet-button is hollow and mounted such as to slide in a watertight manner on the outside of a tubular neck of the said pump body so as to delimit a dosage chamber extending at least partly inside the said tappet-button, and in that stopping means are disposed between the outer wall of the said pump body and the inside of the said tappet-button so as to define, under the stress from elastic means, a predetermined position, referred to as loose, of the tappet-button in relation to the pump body.

According to a preferred embodiment of the invention, the said tappet-button comprises two elements that fit axially into each other, and the stopping means consist of segments connected to the end of a skirt of the inner element of the tappet-button and an annular shoulder or projection defined on the outer wall of the said pump body, the said segments being bent radially inwards when the two elements of the tappet-button are fitted together, so as to create an overall annular stop that can cooperate with the said annular shoulder or projection.

All the elements, with the exception of a spring, can be made from a moulded plastic material. Particularly, in that relating to the inner element of the tappet-button, each segment is advantageously connected to the skirt of the said inner element by a thinner section, a sort of web made by moulding, forming a hinge. In their non-stressed state, the segments extend radially outwards from the outer surface of the skirt of the said inner element, separated from the latter by a series of cuts. This configuration can be removed axially from its mould since it does not have an inner backdraft. Moreover, the inner element of the tappet-button can easily fit around the outer surface of the pump body along which it is designed to slide, beyond the aforementioned annular shoulder or projection, and the placing of the outer element of the tappet-button bends all the segments along the outer wall of the pump body and locks all the components of the pump in position. Each segment has, for example, a triangular radial section and, once bent, the segments are circumferentially adjacent and form a discontinuous crown on the end of the skirt of the inner element of the tappet-button. The fitting by force of the two elements of the tappet-button is stabilised by an inner peripheral rib disposed on the outer element. This rib forms a projection near the free end of the outer element and provides the locking of the inner element fitted into the outer element after bending the said segments. The inner element comprises an axial outlet duct and outlet channels are disposed between the two elements and through the outer element. These channels can be made by a series of cavities made on a conical face of the inner element. In the case of a sprayer, the said channels can be designed such as to define a whirl chamber that enables spraying. Furthermore, a needle valve guided in axial translation in the pump body cooperates with the inner orifice of the said outlet conduit to define an outlet valve. Elastic means made up of a spring exert a stress on the needle valve and the tappet-button to push them axially away from the pump body, so that when the tappet-button is not pressed, it is under the stress of this spring in a position referred to as loose, in which the said overall annular stop of the tappet-button is in contact with the said annular shoulder or projection defined on the outer wall of the pump body.

The needle valve extends beyond the open tubular neck of the pump body, which is inserted in the tappet-button. It comprises at least one lateral longitudinal channel cooperating with the end of the said open tubular portion of the pump body to define an inlet valve.

The aforementioned dosage chamber is thus delimited between the inner wall of the inner element of the tappet-button, the wall of the said needle valve and the end of the said tubular neck. The inlet valve closes when the said tappet-button is pressed, which isolates the dosage chamber from the said reservoir.

BRIEF DESCRIPTION OF THE DRAWINGS

The invention will be better understood and further advantages will appear more clearly in the light of the following description of a dispenser forming a sprayer, provisional conformation, provided only as an example and made in reference to the appended diagrams, in which.

DETAILED DESCRIPTION OF THE INVENTION

Figure 1:
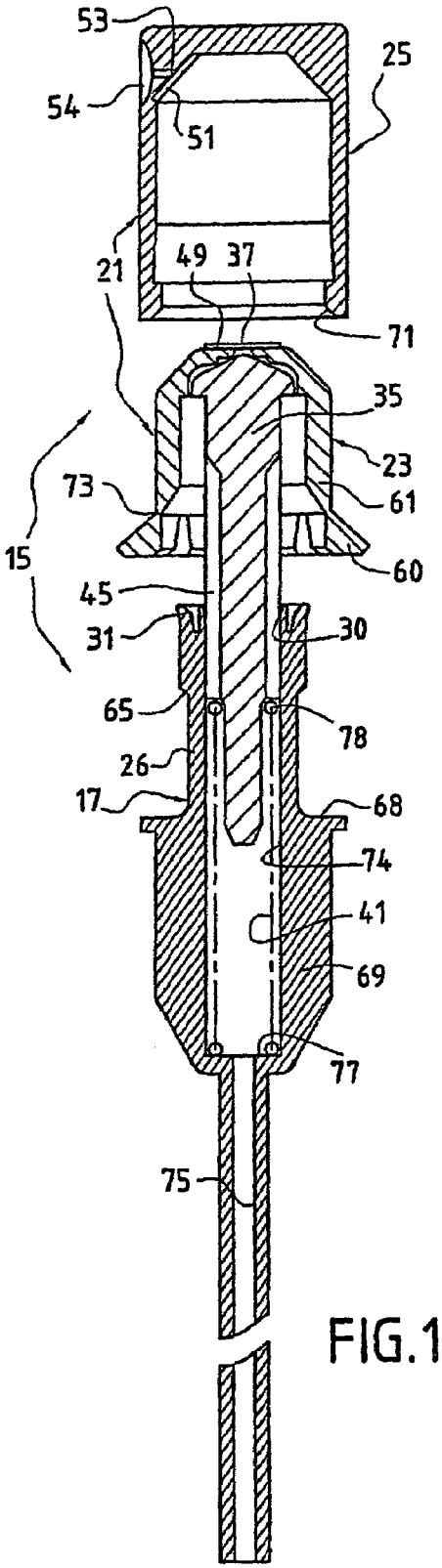
FIG. 1 is an exploded longitudinal section view of the various elements of the pump.
Figure 2:
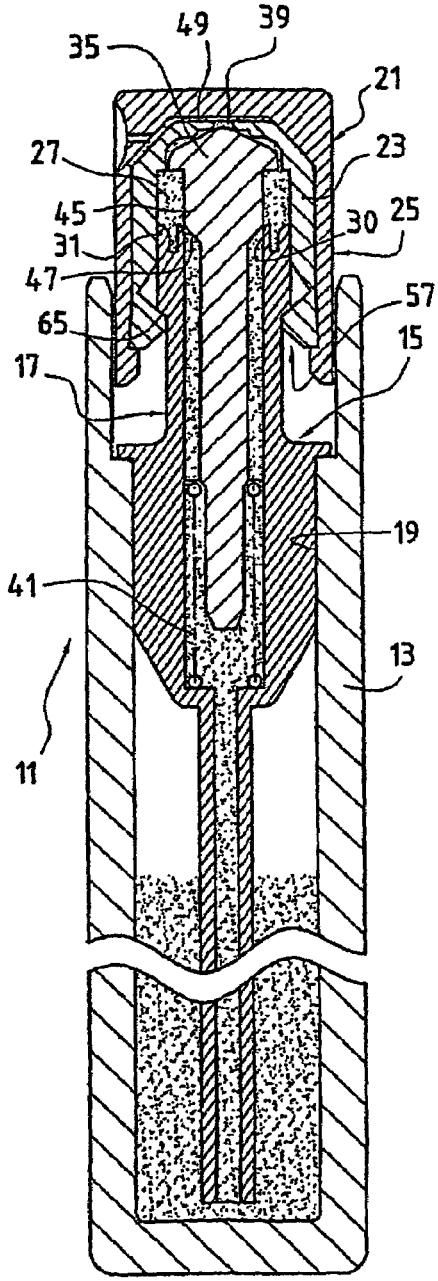
FIG. 2 a longitudinal section of the dispenser, with the tappet-button in the position referred to as loose.

Considering, more particularly, FIGS. 1 and 2, they show a liquid product dispenser 11 in this case forming a sprayer and comprising mainly a reservoir 13 and a pump 15. The pump is of the manually activated type and comprises a pump body 17 mounted watertight in an opening 19 of the said reservoir and a tappet-button 21 mounted in the extension of the pump body and mobile in the axial direction of the latter. The tappet-button 21 is hollow and comprises two elements 23, 25 that fit into each other axially. It is mounted so as to slide in a watertight manner on the outside of an open tubular neck 26 of the pump body and in the extension of the opening of the latter, delimiting a dosage chamber 27 that extends at least partly inside the tappet-button 21 and, more particularly, inside the inner element 23 of the latter. The edge of the opening 30 of the said open tubular portion is formed with a peripheral lip 31 that ensures the watertightness between the pump body and the tappet-button. The pump also comprises a needle valve 35 guided in axial translation in the pump body and extending partly into the space delimited between the pump body and the tappet-button. The inner element 23 comprises an axial outlet conduit 37 and the end of the needle valve cooperates with the inner orifice of this outlet conduit such as to define an outlet valve 39. Elastic means, in this case consisting of a helical spring 41 mounted in the pump body, exert a stress on the needle valve 35 and the tappet-button 21 (by means of the said closed outlet valve) pushing them axially away from the pump body. The needle valve 35 extends beyond the tubular neck 26 of the pump body, which is also inserted in the tappet-button. It comprises at least one lateral longitudinal channel 45 that cooperates with the end of the said tubular neck so as to define an inlet valve 47. This inlet valve is open when the dispenser is not being used; it closes as soon as the tappet-button is pressed, which isolates the dosage chamber. The latter is delimited between the inner wall of the inner element 23 of the tappet-button, the wall of the needle valve 35 and the end of the said tubular neck 26 of the pump body.

Outlet channels are disposed between the two elements of the tappet-button and through the outer element. More particularly, these outlet channels consist of ribs 49 (or grooves) made on the end of the inner element 23, in contact with the said axial outlet conduit 37, and by a cavity 51 made in the inner tapered surface of the outer element. The cavity and the outer wall of the inner element form a whirl chamber. A spraying conduit 53 extends through the outer element between the whirl chamber and a lateral hollow 54 made in the outer surface of the outer element.

According to a remarkable characteristic of the invention, stopping means 57 are disposed between the outer wall of the pump body 17 and the inside of the said tappet-button 21 so as to define, under the stress from the elastic means formed by the spring 41, a predetermined position, referred to as loose (see FIG. 2), of the tappet-button in relation to the pump body. These stopping means 57 comprise segments 60 connected to the end of a skirt 61 of the inner element 23 of the tappet-button. FIG. 1 shows the shape of this inner element and, more particularly, the position of the segments 60 when the said inner element is in the non-stressed state. Furthermore, the outer wall of the pump body (and, more particularly, its tubular neck 26) is provided with an annular shoulder 65 (or a simple annular rib). As shown in FIG. 1, the inner element 23 of the tappet-button, in its non-stressed state, can easily be inserted on the tubular neck 26 of the pump body after the needle valve 35 has been installed, compressing the spring 41 until the segments are positioned between the shoulder 65 and the flange 68 of the plug-shaped part 69 of the said pump body. In this position, the segments 60 are bent radially inwards by fitting the outer element 25 of the tappet-button onto the inner element 23. Thus, all the segments 60 create an overall annular stop that can cooperate with the said shoulder 65 so as to define the position referred to as "loose" of the tappet-button in relation to the pump body, under the stress from the spring 41. The outer element comprises an inner peripheral rib 71 forming a projection near its free end, which provides the locking of the inner element fitted into the outer element after bending the said segments. This is the situation shown in FIG. 2. It can be seen that mounting the outer element 25 of the tappet-button completes and stabilises the assembly of all the elements of the pump. It is also clear that all the elements can be assembled in relation to each other, without indexing. With the exception of the spring, all the elements can be made from a moulded plastic material. Particularly, the shape of the inner element 23 of the tappet-button, in its non-stressed state, in other words with the segments extending radially outwards from the outer surface of the skirt and separated by cuts, is a part that can easily be removed axially from its mould, since it does not have any kind of inner backdraft (see FIG. 1).

Each segment 60 is connected to the said skirt of the inner element by a thinner section 73, made by moulding, forming a hinge. Each segment has a triangular radial section and, when all the segments are bend radially inwards, they are circumferentially adjacent and form a discontinuous crown on the end of the said skirt 61, which can cooperate with the shoulder 65 defined on the pump body.

The end of the needle valve 35 and the bottom of the cavity of the inner element 23 of the tappet-button have complementary shapes so that the needle valve is correctly guided to rest against the orifice of the outlet conduit 37. The pump body comprises a guiding conduit 74 that communicates with a suction tube 75 and the needle valve 35 comprises an essentially cylindrical section that slides in the guiding conduit, which is provided with a bottom shoulder 77. The needle valve 35 also comprises a shoulder 78, and the spring is mounted with initial pre-compression between these two shoulders. The end of the tubular neck 26 of the pump body comprises an annular groove that increases the flexibility of the peripheral lip 31 in watertight contact with the cylindrical inner wall of the inner element of the tappet-button. The longitudinal channel or channels 45 communicate with the dosage chamber at their ends when the tappet-button is in the position referred to as loose.

The plug-shaped part of the pump body 69 is inserted by force in the opening 19 of the reservoir. This opening is surmounted by a thinner collar, in which the cylindrical outer skirt of the tappet-button is mounted. The presence of a vent is not required if the reservoir is only partially filled.

Figure 3:
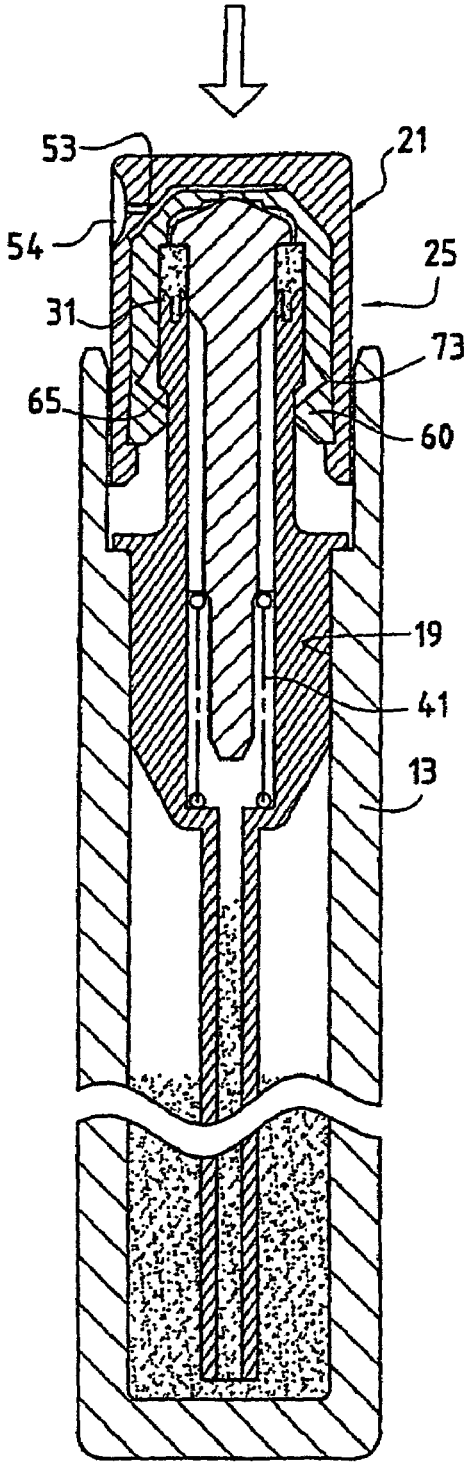
FIG. 3 is a similar view to FIG. 2, at the start of a spraying phase.
Figure 4:
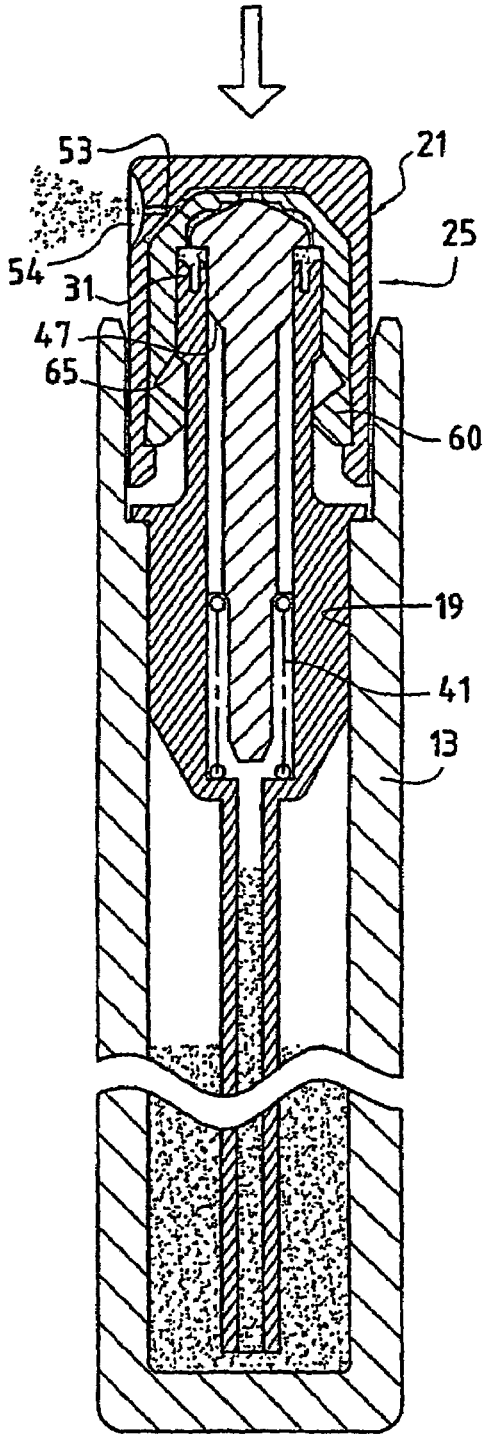
FIG. 4 is a similar view to FIG. 2, during the spraying action.
Figure 5:
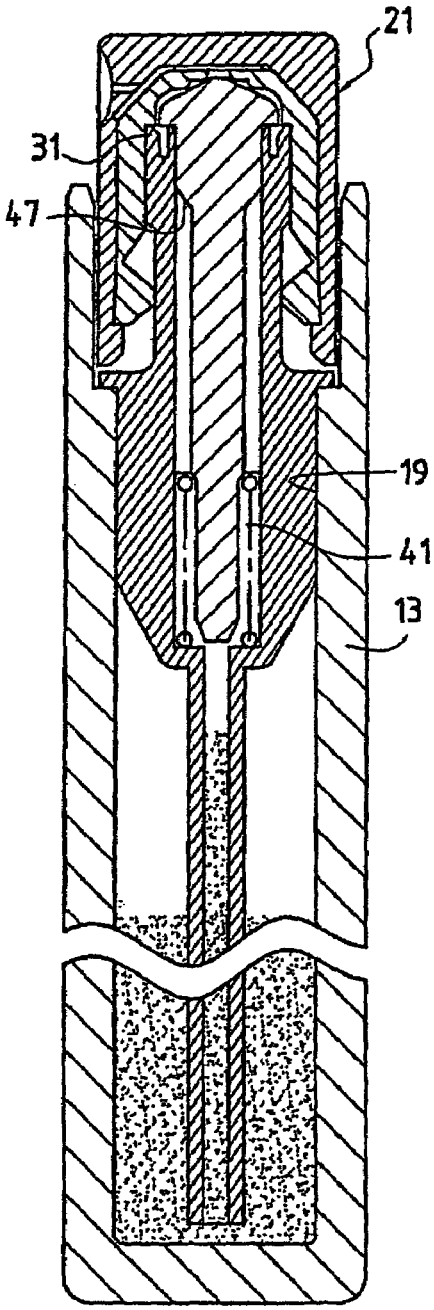
FIG. 5 is a similar view to FIG. 2, at the end of the spraying phase.
Figure 6:
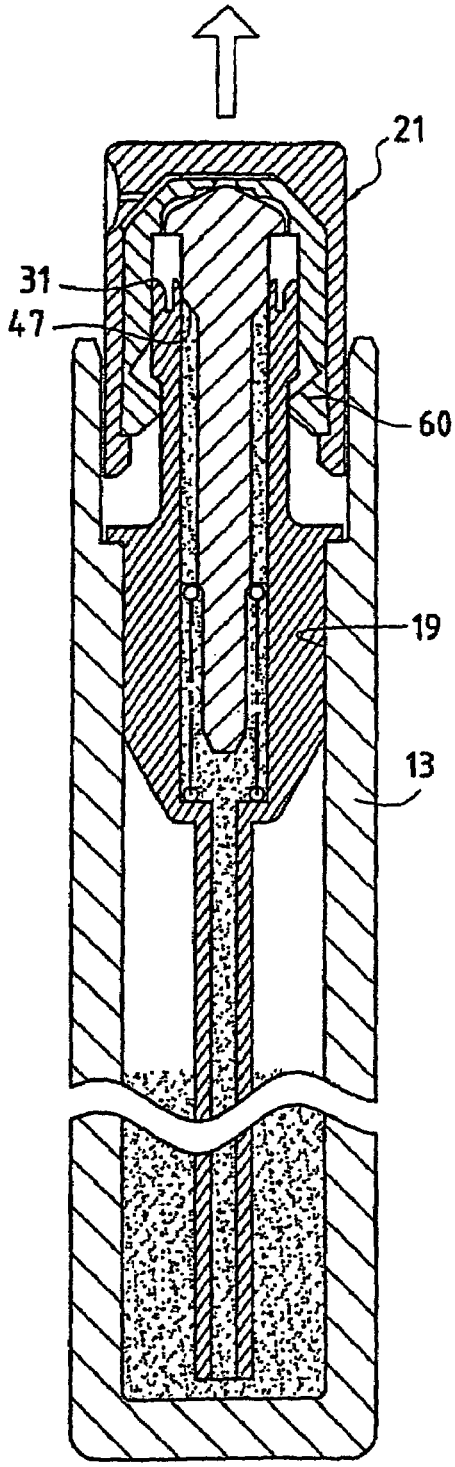
FIG. 6 is a similar view to FIG. 2, showing the return of the tappet-button to its position referred to as loose.

The operation takes place as seen in the preceding description. FIG. 2 shows that the dosage chamber 27 is at its maximum volume and that the communication between this dosage chamber and the reservoir is not interrupted since the ends of the lateral longitudinal channels establish the communication between the reservoir 13 and the said dosage chamber. Conversely, as soon as the tappet-button is pressed (FIG. 3), this communication is interrupted, since the needle valve 35, still in contact with the tappet-button, begins to enter the guiding conduit 74, closing off the said inlet valve. As of this time, the liquid contained in the dosage chamber 27 is placed under pressure. This results in a separation between the needle valve 35 and the inner surface of the inner element 23 of the tappet-button and, consequently, the opening of the outlet valve 39 and a reduction of the volume of the dosage chamber which results in the expulsion and spraying of the liquid. This is the situation shown in FIG. 4. When the tappet-button is completely pushed down, the dosage chamber practically disappears and the needle valve 35 comes back into contact with the inner surface of the inner element 23 of the tappet-button. This is shown in FIG. 5. Releasing the tappet-button results in the needle valve and tappet-button assembly rising back up under the action of the spring 41 and the creation of a vacuum in the dosage chamber, which gradually increases its volume, which causes the suction of a new dose of liquid, when the inlet valve opens up again. This is shown in FIG. 6. At the end of this process, the dispenser returns to the position shown in FIG. 2.

What is claimed is:

1. A liquid product dispenser comprising a reservoir and a manually activated pump comprising a pump body mounted watertight in an opening of said reservoir and a tappet-button mounted in an extension of said pump body and mobile along the axial direction of the latter, characterized in that said tappet-button is hollow and mounted such as to slide in a watertight manner on the outside of a tubular neck of said pump body so as to delimit a dosage chamber extending at least partly inside said tappet-button and in that stopping means are disposed between an outer wall of said pump body and the inside of said tappet-button so as to define, under the stress from elastic means, a predetermined position, referred to as loose, of the tappet-button in relation to the pump body, and further characterized in that said tappet-button comprises two elements that fit axially into each other and in that the stopping means comprises segments connected to the end of a skirt of an inner element of the tappet-button and an annular shoulder or projection defined on the outer wall of said pump body, said segments being bent radially inwards when two elements of the tappet-button are fitted together, so as to create an overall annular stop that can cooperate with said annular shoulder or projection.

2. A dispenser according to claim 1, characterized in that each segment is connected to said skirt of the inner element by a thinner section made by moulding and forming a hinge.

3. A dispenser according to claim 2, characterized in that each segment has a triangular radial section.

4. A dispenser according to claim 3, characterized in that said segments are circumferentially adjacent and form a discontinuous crown on the end of said skirt.

5. A dispenser according to claim 4, characterized in that, in their non-stressed state, said segments extend radially outwards from the outer surface of said skirt, separated by cuts, according to a configuration that can be removed axially from its mould.

6. A dispenser according to claim 1, characterized in that the outer element of said tappet-button comprises an inner peripheral rib which forms a projection near a free end of this element and ensures the locking of the inner element fitted into the outer element after bending said segments.

7. A dispenser according to claim 1, characterized in that said inner element comprises an axial outlet conduit and in that outlet channels are disposed between the two elements and through an outer element of the tappet-button.

8. A dispenser according to claim 7, characterized in that said dispenser comprises a needle valve guided in axial translation in said pump body and extending in a space delimited between the pump body and the tappet-button, in that said needle valve cooperates with an inner orifice of said outlet conduit so as to define an outlet valve and in that said elastic means exert a stress on said needle valve and said tappet-button, pushing them axially away from the pump body.

9. A dispenser according to claim 8, characterized in that said needle valve extends beyond said tubular neck of the pump body and in that said needle valve comprises at least one lateral longitudinal channel that cooperates with the end of said tubular neck so as to define an inlet valve, the aforementioned dosage chamber being delimited between an inner wall of said inner element of the tappet-button, the wall of said needle valve and said open tubular section.

10. A dispenser according to claim 8, characterized in that said pump body comprises a guiding conduit in which said needle valve slides, in that said guiding conduit is provided with a bottom shoulder, in that said needle valve comprises a shoulder and in that the aforementioned elastic means are made up of a spring mounted with pre-compression between these two shoulders.

11. A liquid product dispenser comprising a reservoir and a manually activated pump comprising a pump body mounted watertight in an opening of said reservoir and a tappet-button mounted in an extension of said pump body and mobile along the axial direction of the latter, characterized in that said tappet-button is hollow and mounted such as to slide in a watertight manner on the outside of a tubular neck of said pump body so as to delimit a dosage chamber extending at least partly inside said tappet-button and in that stopping means are disposed between an outer wall of said pump body and the inside of said tappet-button so as to define, under the stress from elastic means, a predetermined position, referred to as loose, of the tappet-button in relation to the pump body, further characterized in that said tappet-button comprises two elements, an inner element and an outer element, that fit axially into each other, in that said inner element comprises an axial outlet conduit and in that outlet channels are disposed between the two elements and through said outer element, and further characterized in that said dispenser comprises a needle valve guided in axial translation in said pump body and extending in a space delimited between the pump body and the tappet-button, in that said needle valve cooperates with an inner orifice of said outlet conduit so as to define an outlet valve and in that said elastic means exert a stress on said needle valve and said tappet-button, pushing them axially away from the pump body.

12. A dispenser according to claim 11, characterized in that said needle valve extends beyond said tubular neck of the pump body and in that said needle valve comprises at least one lateral longitudinal channel that cooperates with the end of said tubular neck so as to define an inlet valve, the aforementioned dosage chamber being delimited between an inner wall of said inner element of the tappet-button, the wall of said needle valve and said open tubular section.

13. A dispenser according to claim 11, characterized in that said pump body comprises a guiding conduit in which said needle valve slides, in that said guiding conduit is provided with a bottom shoulder, in that said needle valve comprises a shoulder and in that the aforementioned elastic means are made up of a spring mounted with pre-compression between these two shoulders.

* * * * *